US005853563A

United States Patent [19]

Ripley et al.

[11] Patent Number: 5,853,563

[45] Date of Patent: Dec. 29, 1998

[54] TREATMENT OF WASTE PETROLEUM

[76] Inventors: Ian Stanley Ripley, 75 The Willows, Marton, Middlesbrough, Cleveland TS7 8BP; Antony Hugh Needham, 50 Thames Avenue, Guisborough, Cleveland TS14 8AF, both of Great Britain

[21] Appl. No.: 492,070

[22] PCT Filed: Jan. 19, 1994

[86] PCT No.: PCT/GB94/00099

§ 371 Date: Sep. 14, 1995

§ 102(e) Date: Sep. 14, 1995

[87] PCT Pub. No.: WO94/17155

PCT Pub. Date: Aug. 4, 1994

[30] Foreign Application Priority Data

Jan. 19, 1993 [GB] United Kingdom ..... 9300969

[51] Int. Cl.[6] ..... C10G 21/00

[52] U.S. Cl. ..... 208/13; 208/179; 208/186; 208/187; 210/768; 210/772; 210/787

[58] Field of Search ..... 208/13, 179, 180, 208/181, 184, 186, 187, 177; 210/768, 772, 787

[56] References Cited

U.S. PATENT DOCUMENTS

| | | | |
|---|---|---|---|
| 3,696,021 | 10/1972 | Cole et al. | 208/13 |
| 3,951,779 | 4/1976 | Anderson | 208/11 LE |
| 4,054,505 | 10/1977 | Hart, Jr. et al. | 208/11 LE |
| 4,054,506 | 10/1977 | Hart, Jr. et al. | 208/11 LE |
| 4,495,057 | 1/1985 | Amirjafari et al. | 208/11 R |
| 4,648,964 | 3/1987 | Leto et al. | 208/390 |
| 4,875,998 | 10/1989 | Rendall | 208/390 |
| 4,954,267 | 9/1990 | Uremovich | 210/771 |
| 5,156,751 | 10/1992 | Miller | 210/787 |
| 5,186,817 | 2/1993 | Paspek et al. | 208/188 |

*Primary Examiner*—Berkir L. Yildirim
*Attorney, Agent, or Firm*—Dorsey & Whitney

[57] ABSTRACT

A treatment of waste petroleum (60,70) is disclosed by decoupling association of the petroleum component to contaminants by solvent treatment (92,94) of the petroleum component, followed by ultrasonic treatment (59,71), separating the contaminants by extraction with a non-solvent (44,46) for the petroleum and solvent and then separating the petroleum. The washed petroleum is then distilled to remove solvent followed by hydroseparation and centrifugation to isolate the petroleum (67). The solids can be subjected to a hot fluid treatment in a toroidal dynamic bed (50) to free up the petroleum residues in the solid particles.

23 Claims, 2 Drawing Sheets

TREATMENT OF WASTE PETROLEUM

BRIEF DESCRIPTION OF THE INVENTION

Decoupling the association of the petroleum component in waste petroleum to contaminants therein by a combination of solvent and ultrasonic treatments. A variety of separations techniques isolate environmentally safe petroleum and solids contaminants.

BACKGROUND TO THE INVENTION

Dotting the earth are waste petroleum deposits[1] ranging from "mountains" of plastic bags loaded with waste petroleum sludges heaped on a half square mile area of Singapore's Pulau Sebarok, residues stored in tanks or slops taken from vessels, to the vast Orinoco asphalt deposits in Venezuela and Trinidad. All but the Orinoco deposits are manmade. The Orinoco deposit is a product of nature. Singapore's sludges, taken from ship's storage tanks, varies in composition from bag to bag. They are there because Singapore's authorities have not found a cost effective method to dispose of them. Incinerating any sludge or other form of waste petroleum is not cost effective or environmentally acceptable because of the necessity of dealing with $NO_x$, $SO_x$ and heavy metal emissions. Westwardly are Bahrain's seven pitch ponds having a total area of seventy thousand square meters loaded with black petroleum residues dumped by a refinery in 1938–1942. The only changes to this resting pitch body over the years are those gently wrought by natural forces, such as dusting over by desert sands, evaporation by the searing Asia Minor (Middle East) heat and deposition of rain water and migrated sea water. This "Bahrain pitch" has been a serious environmental problem for all these years.

[1] The term waste petroleum is used herein to encompass oil in any form ranging from crude to refined oil and asphalt materials ranging from asphalt created by nature's deposition of oil and man's deposit of oil and includes oil slop, tank cleaning water, tank residues, black oil residues, oil sludge from petroleum carriers, and the like.

Like conditions, with obvious modifications, exist throughout the world. Hardly a country is exempt. Many refineries refuse to acknowledge their waste petroleum problems. Others have made limited attempts to deal with them. In many cases, the problem derives from refineries depositing the waste petroleum in landfills. Eventually, this method results in ground water spoilage with the deposited waste petroleum taking on an even greater B, S & W (basic sediment and water) content, which only compounds the recovery issues. Where the level of pollution is vast and its correction costly, many polluters rely on political manipulations either to delay dealing with it or transferring the cost to the public.

Waste petroleum deposits frequently take on unplanned complications. For example, Singapore's authorities bagged the sludges for containment but with time, stored bags became damaged causing petroleum to ooze into the ground. That requires treatment of the earth under the bags for removal of the petroleum deposited. Other waste deposits in landfills end up with petroleum mixed with large amounts of water. In that case, there are two or more types of waste petroleum, e.g., one with high solids content and another with high water content.

There are many potential techniques, chemical and engineering, for safely eliminating waste petroleum. Until this invention, no one or combination of techniques, has provided a complete solution that is economically viable. The difficulty in solving this pollution problem is tied to a number of factors. Most of the waste petroleum has a variable composition, which impacts on the efficiency of the steps of the processes. Typically, each step is designed for a certain waste petroleum composition. That step becomes less efficient when the composition is materially altered. Additionally, waste petroleum deposits frequently become dumping grounds for a host of materials that typically are found in a common waste ("garbage") deposit. Even where the waste petroleum is relatively homogeneous as is the case with Bahrain pitch, the variability of composition is still sufficiently great to adversely affect efficiency of separation of impurities from the waste petroleum.

Waste petroleum, whether it is a residue or pitch, is contaminated with significant amounts of solids. The solids content can range from over 1 up to 99 weight percent of the waste petroleum. Ground spills are capable of spanning this range. Generally, the solids content ranges from about 2 to about 50 weight percent of the waste petroleum. Usually, the solids content of waste petroleum within any source will vary. Removal of the solids is not a major project if one is unconcerned with the amount of petroleum retained by the solids. The petroleum content can be higher than 4–10 percent of the weight of the solids ultimately separated from the waste petroleum. At those levels of impurities, the solids are environmentally unsafe for landfills. Laws exist in many countries prohibiting such landfills. It would be desirable to separate the solids content so that it is relatively free of petroleum, for example, solids that contain less than about 1 weight percent of petroleum.

A number of the processes that are promoted for the treatment of waste petroleum employ a briquetting technique for accumulating the solids containing a residual petroleum content, into a form suitable for applications. This technique suggests the use of the briquets as a construction material This merely slows the environmental problem, not eliminate it. Over time, nature will break down the briquets and eventually the retained petroleum leaches into the earth.

A process for treating waste petroleum has limited capabilities if it is incapable of treating the gamut of existing waste petroleum. In any waste petroleum treatment, one may know in advance a portion of the solids composition of the deposit that is to be cleaned up. But what is not so easily predictable is the variability in solids content of sections of the deposit. This is true even when dealing with a landfill such as Bahrain pitch where the solids content varies from area to area of each pond. That variability goes up significantly in the case of Singapore's sludges (as well as other sludges) where solids content covers the map and one is unsure of the solids content from bag to bag. Some bags contain sawdust; others contain rags; still others contain polyethylene bags. Such contaminants can foul up the equipment used in treating the waste petroleum. A process developed to treat Bahrain pitch only is inadequate for treating Singapore's sludges.

Some of the factors complicating the creation of a universal approach to treating waste petroleum are:

1. When the solids content in a waste petroleum is high, greater than 15–20 weight percent, the viscosity of the material becomes a major processing issue. The viscosity of the material must be low enough for it to be transported to the first stage of the process.
2. Petroleum has a great affinity for the solids, such as siliceous materials, and becomes tightly associated with them. Unless that association is broken, the petroleum will jump from stage to stage of the process tightly bound to the solids.
3. Water is ever present in waste petroleum. It is tightly bound to the solids and forms emulsions with petroleum that are difficult to break. Costly chemical cocktails are conventionally used for the demulsification of petroleum and water. Such chemicals tend to reappear undesirably in the recovered product and interfere with subsequent refinery processes. The removal of water to tolerated levels is typically a foreboding problem in the treatment of waste petroleum.

4. There are other impurities that adversely affect waste petroleum treatment. Sulfur is a common impurity because of its chemical affinity for many of the chemical structures making up petroleum. Its removal to tolerable levels may be imperative if the petroleum is recovered for subsequent use without additional refining. Even if the petroleum is removed by incineration, as noted above, $NO_x$, $SO_x$ and heavy metal emissions from such combustion is environmentally unacceptable.

There is a need for a technology that has universal application for the treatment of waste petroleum. The technology should be capable of recovering petroleum where feasible, in a form that allows its use as a fuel, or cleans it up sufficiently that the petroleum can be sent to a refinery for further processing to make higher quality petroleum products. This avoids the problems associated with incinerating the petroleum. The process should be capable of handling variable solids and water contents, resulting in the recovery of petroleum with acceptably low B, S & W. Preferably, all impurities are made environmentally safe. For example, the solids that are recovered should be sufficiently free of petroleum that they can be disposed of according to the strictest environmental standards. It is the object of the invention to meet these needs and capabilities.

Much equipment is available for handling petroleum mixtures but none have the capability and flexibility to solve these waste petroleum problems. Our research has shown that a judicious selection of such equipment, each chosen to accomplish a limited task, can be combined to create a process that has the capability of dealing with essentially all types of waste petroleum problems, ranging from slops removed from ships, asphalt deposits such as the Bahrain pitch, Singapore's sludges and other sludges, and the like. Illustrative of such an apparatus is that described in Dodson, U.S. Pat. No. 4,479,920, patented Oct. 30, 1984, for the treatment of solids in a toroidal dynamic bed. The technology embodied in the patent, called the "Torbed Process," is being licensed by Davy McKee (London) Limited, London, U.K. The Torbed Process is recommended (Gtoszek, "The Torbed Process: A Novel Concept in Heat and Mass Transfer," International Deep Mining Conference: *Innovations in Metallurgical Plant,* Johannesburg, SAIMM, 1990 and product brochure) for a number of applications, including:

The calcination of clays and lime, magnesite and dolomites to yield both 'dead-burnt' and highly reactive products;

The combustion of low calorific value/high ash content fuels in which the carbon burnout was in excess of 99%;

The production of lightweight aggregates through the firing and 'bloating' of clays;

Toxic waste incineration;

Regeneration of activated carbons;

Regeneration of catalysts;

Drying of sand, filter cakes, concentrates;

Vaponzation;

Gasification;

Pyrolysis;

Heat transfer.

The advantages of the Torbed Process are alleged to be:

(a) A substantial decoupling of support medium mass flow and 'fluidizing' velocity is achieved;

(b) High rates of heat and mass transfer may be realized by utilizing the high impingement velocities of the process gas stream;

(c) The dissipation of the velocity of the support medium provides the means of processing a widely graded material;

(d) Irregular shapes may be processed under strictly controlled conditions;

(e) The low mass and thermal inertia of the bed permits rapid responses to process controls;

(f) There is a low static pressure loss across the toroidal dynamic bed.

Other patents dealing with the Torbed Process include: U.S. Pat. No. 4,559,719; U.S. Pat. No. 4,909,811; U.S. Pat. No. 4,952,140; U.S. Pat. No. 5,033,205; European Patent Public. 0 346 004 and U.S. Pat. No. 5,075,981. As can be seen from the description of this apparatus, it deals with specific tasks. As will be shown below, it can be incorporated with other equipment in an overall waste petroleum process that involves the recovery of petroleum associated with siliceous particles.

THE INVENTION

This invention relates to a process for reclaiming petroleum from waste petroleum in a form that allows the petroleum as such to be used as a fuel, further refined to produce useful petroleum products such as fuels or economically and safely disposed of by incineration. One feature of the invention is the separation of impurities from the waste petroleum, where the impurities are recovered in an environmentally safe form. Another feature of the invention is its ability to effectively process all kinds of waste petroleum, ranging from slops removed from ships, sludges, tank residues to asphalt or pitch in ponds or underground deposits.

The invention encompasses the treatment of waste petroleum by decoupling the association of the petroleum component to contaminants therein by solvent treatment of the petroleum component, followed by ultrasonic treatment and separation of contaminants by washing with a non-solvent for the petroleum and solvent components, and then separating the petroleum from the contaminants.

Two steps of the process initiate the facile separation of petroleum from waste petroleum that contains water and solids. First, the waste petroleum is dissolved in a water-immiscible solvent for the petroleum component, and second, the mixture containing the solvent is subjected to ultrasonic waves. The ultrasonic treatment is monitored to facilitate separation of the petroleum from the solids without significant emulsification of water and petroleum. The combination of solvent and ultrasonic treatments activates the solvation of the petroleum such that more is extracted from solids on a per volume basis than with the solvent treatment alone. The treated mixture is further washed with a non-solvent for the solvent and the petroleum. This results in a mixture of extracted petroleum and solvent, and a separated solids component freed of a major amount of its associated petroleum.

Next in the process are a variety of process steps that refine the level of purification of the petroleum and the solids. The separation step may be any traditional separation including, but not limited to, distillation, condensation, extraction, filtration, centrifugation, vaporization, and the like.

After separation of the solvent from the recovered petroleum by distillation, the petroleum-rich component is subjected to hydroseparation. The hydroseparation may be a single- or multi-step process, and optionally, is followed by decantation and/or centrifugation to separate out any residual solids.

The solids that are recovered are rendered substantially free of petroleum contamination by a number of processes. In those cases where the solids are not fully freed of a petroleum content, the solids may be subjected to a toroidally-shaped dynamic bed under vaporization conditions. In this fashion, the last of the petroleum bonded to the solids is vaporized and separately recovered leaving solid particulate matter having a petroleum content of less than about 1 weight percent, preferably less than about 0.5 weight percent, most preferably less than about 0.1 weight percent. Alternatively, the solids may be subjected to a conventional combustion to burn out the last residual petroleum.

The process of the invention is capable of treating waste petroleum compositions having a variable solids or petroleum content. The process is capable of treating low to high solids containing waste petroleum compositions. For example, the solids content may be as low as about 1 weight percent to about 99 weight percent, basis weight of the waste petroleum composition. The petroleum content of the waste petroleum composition may be equally variable, owing to the fact that much waste petroleum involves petroleum dumped in landfills or slops where the petroleum has been mixed with various solids including rags, plastic, paper, sand, water, ferrous and ferric oxides, carbonaceous materials, and the like, to form sludges with a wide range of concentrations. Thus, the petroleum content of the waste petroleum composition may be as little as about 1 weight percent to about 99 weight percent of the waste petroleum. Water contents of waste petroleum can be equally variable. The process of the invention is capable of dealing with such variability in composition, but should one desire to mitigate in the operation of the process the variability issue, there are simple ways of doing this. One way of controlling the composition of the waste petroleum is to mix (homogenize) enough of the variable waste composition to exceed the throughput of a cycle of the process of the invention so that in any cycle of the process, there is an average composition being treated. In this manner, fluctuations in composition may be avoided in the course of a process cycle. Under such circumstances, the waste petroleum composition is mixed in a holding tank having sufficient capacity to homogenize enough waste petroleum composition for at least a cycle of the process. A cycle of process is defined as that amount of materials to fill the equipment of the process from start to finish. Start of the process is defined when solvent is first added to the waste petroleum composition. Finish of the process is defined when petroleum is essentially completely separated from the solids contaminants, i.e., the petroleum contains less than about 1 weight percent of solids.

The process contemplates the vaporization of petroleum from siliceous and other particulate particles (clays, floccular materials with a high ferrous content typically originating from rust flakes, carbonaceous materials, and the like) by introducing such particles, as well as particles associated with the waste petroleum that do not directly contain petroleum, to a toroidal dynamic bed at a temperature above the volatilization temperature of the petroleum and below the temperature of combustion of the petroleum whereby the petroleum is vaporized from the particles. The volatilized petroleum is thereafter isolated from the particles and condensed. The siliceous and other type particles are typically free of petroleum contamination to the extent that the petroleum content of the particle is less than 1 weight percent of the weight of the particles. Preferably, the petroleum content is less than 0.5 weight percent, most preferably less than 0.1 weight percent. As a result, the particles may be deposited in landfills without any adverse environmental impact.

DETAILED DESCRIPTION OF THE INVENTION

Figure 1:
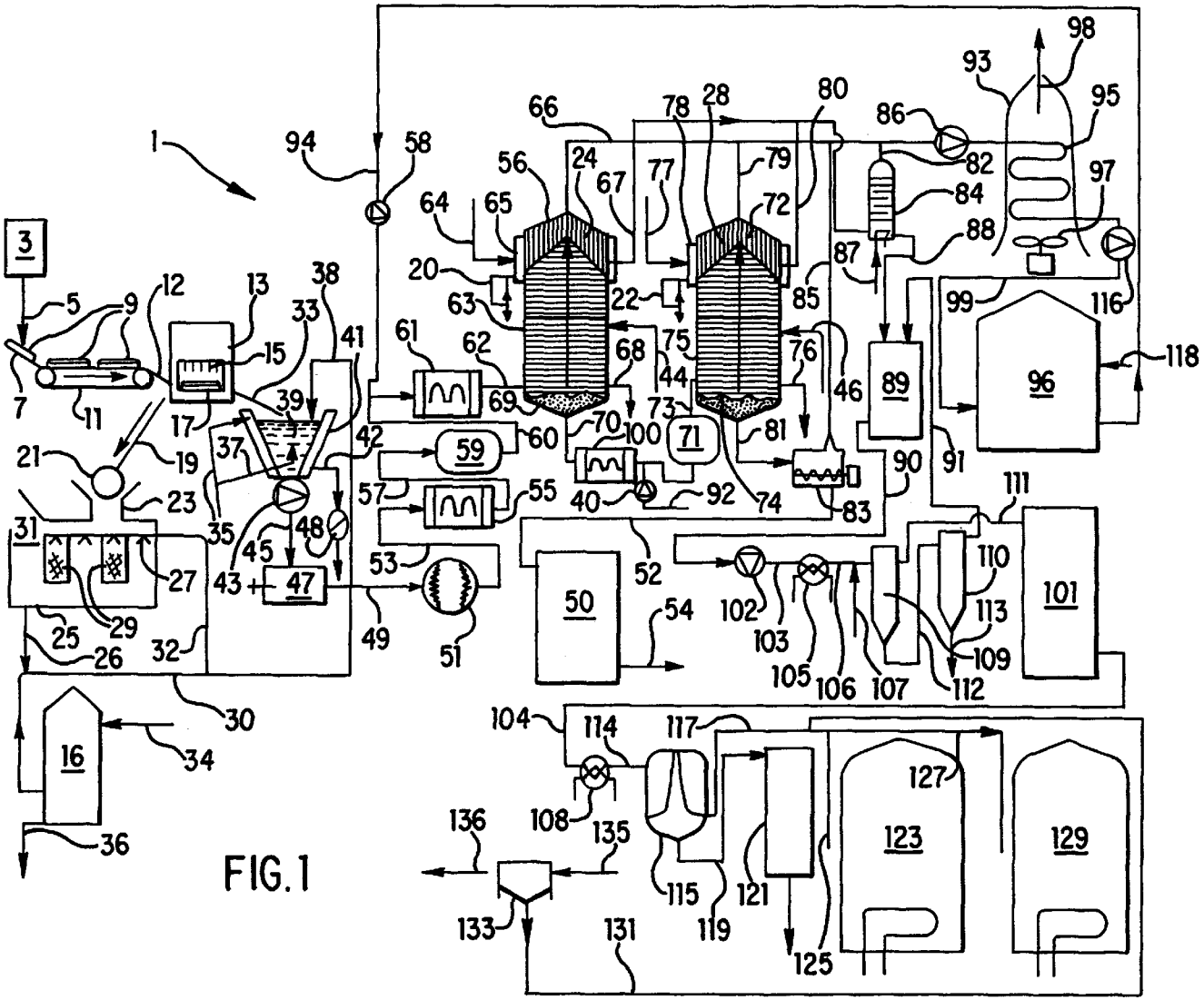
FIG. 1 is a schematic flow chart description of the process of the invention.
Figure 2:
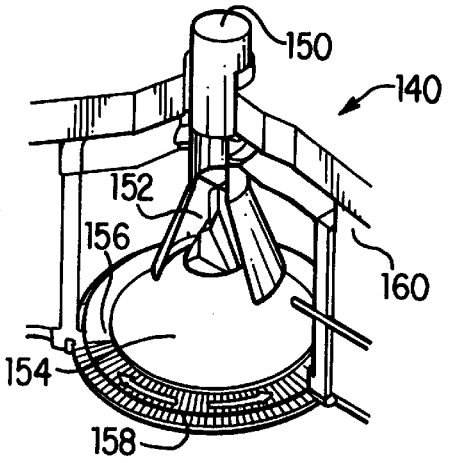
FIG. 2 is a cutaway perspective view of a toroidal dynamic bed apparatus illustrating circulatory and toroidal particle motion.

The process of the invention involves a number of steps focused on facilitating separation of the petroleum component of the waste petroleum from the solid sedimentary component. This is accomplished by subjecting the waste petroleum, in an initial phase of the separation process after dissolution of a solvent for the petroleum component, to an ultrasonic treatment at a rate in cycles per second sufficient to note an increase in the separation of the solids component from the petroleum component. The limit on the rate in cycles per second should not be so high as to significantly increase emulsification of water in the petroleum so that it is not possible to remove the water downstream in the process. The ultrasonic treatment may follow a solvent treatment of the waste petroleum or a preliminary ultrasonic treatment combined with solvent treatment. Some of the solids in the waste petroleum may be removed prior to the ultrasonic treatment by filtration, centrifugation, decantation, and the like procedures, when the nature of the waste petroleum allows this.

In the typical case, the ultrasonic treatment is in the kilohertz region of cycles per second, i.e., over about 1,000 cycles per second. Desirably, the treatment is carried out at greater than about 15 kHz, generally in the range of about 15 kHz to about 60 kHz. More preferably, the treatment is carried out at 20 kHz to about 45 kHz.

A simple laboratory experiment demonstrates the effect of ultrasonic treatment in the performance of the process of the invention. A raw sample of Singapore's sludge characterized below, is used in the experiment. The formulation samples cited in table A below were treated by mixing with a conventional stirrer and then by ultrasonic treatment as indicated and the separations were measured and tabulated.

TABLE A

| Sample No. | Formulation | parts by weight | Mixing Conditions | Results | parts by weight |
|---|---|---|---|---|---|
| 1 | Raw Sludge | 100 | 50° C. at 1400 rpm | Oil and Solvent | 310 |
| | Kerosene solvent | 30 | for 15 minutes | Water | 163 |
| | 3% Salt Water | 400 | | Recovered solids | 57 |
| | Total | 530 | | (wet) | |
| | | | | Total | 530 |
| | | | | Washing efficiency on solids, % oil retained | 48 Viscosity |
| | | | | Viscosity of recovered oil, poise at 50° C. | 3.1 |
| 2 | Same as sample 1 | | Ultrasonic vibration for 1½ minutes at 25 kHz at 50° C. | Oil and Solvent | 156 |
| | | | | Water | 321 |
| | | | | Recovered solids | 53 |
| | | | | (wet) | |
| | | | | Total | 530 |
| | | | | Washing efficiency on solids, % oil retained | 43 Viscosity |
| | | | | Viscosity of recovered oil, poise at 50° C. | 2.6 |
| 3 | Recovered solids from 1 & 2 | 100 | Same as Sample 1 | Solids & Solvent | 318 |
| | | | | Water (oily) | 159 |
| | Kerosene solvent | 30 | | Recovered solids | 53 |
| | 3% Salt Water | 400 | | (Wet) | |
| | Total | 530 | | Total | 530 |
| 4 | Same as sample 3 | | Same as Sample 2 | Solids & Solvent | 370 |
| | | | | Water (oily) | 125 |
| | | | | Recovered solids | 35 |
| | | | | (Wet) | |
| | | | | Total | 530 |

Subsequent steps of the process involve separation of water from the petroleum, final separation of sediment from the petroleum, treatment of the separated sediment to prepare it for disposal and the like. To illustrate the operation of a preferred embodiment of the process of the invention reference is made to FIG. 1.

FIG. 1 schematically illustrates the separation system 1 that starts with waste petroleum storage facilities 3. The objective of system 1 is to treat waste petroleum sludges, obtained from Singapore, described above, that has been stored in polyethylene bags reinforced by polypropylene fabric, with standard proven process equipment having the capability of handling variations in feed stock composition and properties. The following, comparing in part earlier samples provided by the Port of Singapore Authority (PSA), is a general visual characterization of sludges that were provided in eight drums:

In drums 1, 2 and 3, the product was very soft and oily, little sign of the lumps with high iron content and specific gravity that were evident in an earlier sample provided by PSA.

Drum 4 contained bags (representing 2–5 weight percent of the all the drums' contents) comprising sawdust, debris such as gloves, cans, stones and split new bags.

Drums 5, 6 and 7 contained products varying from solids "slabs" to viscous thick liquid similar to the material in Drums 1, 2 and 3.

Drum 8 contains material similar to that provided earlier by PSA.

All of the bags from the eight drums contained a lot of extraneous matter including shredded polyethylene film from bags and disintegrated rags.

An analysis of these materials is as follows:

| | PSA | Sample From Drum No. | | | | | | | |
|---|---|---|---|---|---|---|---|---|---|
| Test: | Sample | 1 | 2 | 3 | 4 | 5 | 6 | 7 | 8 |
| Water content, % w/w | 14 | 51 | 22 | 30 | — | 15 | 27 | 20 | 31 |
| Petroleum content, % w/w | 30 | 38 | 61 | 57 | — | 29 | 37 | 32 | 56 |
| Solids content, % w/w | 56 | 11 | 17 | 13 | — | 56 | 36 | 48 | 13 |
| Viscosity @ 50° C., poise | 2.19 | 3.0 | 1.7 | 1.75 | 3.0 | 3.1 | 2.78 | 2.9 | 3.1 |
| Pour point °C. | +7 | 0 | −4 | 0 | +2 | +3 | +2 | +3 | −3 |
| Sp.G. @ 25° C., recov- | | | | | | | | | |

-continued

An analysis of these materials is as follows:

| Test: | PSA Sample | Sample From Drum No. 1 | 2 | 3 | 4 | 5 | 6 | 7 | 8 |
|---|---|---|---|---|---|---|---|---|---|
| ered petroleum | 0.876 | 0.9 | 0.85 | 0.88 | 0.9 | 0.86 | 0.88 | 0.87 | 0.84 |
| Notes on solids | metallic | sandy | sandy | sandy/ metallic | — | sandy | sandy | sandy | sandy/ metallic |

The PSA states that the bulk of the oil sludges originates from the scrapping/scraping of the bottom of the cargo tanks of petroleum oil tankers preparing for gas-freeing prior to entering the shipyards of Singapore. The sludges varies from slurry-like to mud-like to clay-like, with specific gravity varying from 1.01 to 1.8. The sludges may emit dangerous petroleum vapor when disturbed or heated. The sludges are packed into bags for ease of handling onboard the tankers. The bags are made of two layers, an inner polyethylene layer and an outer polypropylene fabric layer. The sludges consists mainly of rust flakes, impregnated with crude oil and sea water mixture. According to the PSA, there may be odd pieces of metal objects, rags, and the like, inside the sludge bags. They state the composition of the sludges varies as follows:

| | |
|---|---|
| Oil | 20 to 60% |
| Water | 15 to 40% |
| Solids | 15 to 60% |

The sludges are held in storage facility 3 in 30–60 kg bags 9. Bags 9 are withdrawn from stock by a forklift truck [represented by 5], which is equipped with a bucket fitting to enable damaged bags to be handled, and deposited on a loading table 7, then onto conveyor 11. Conveyor 11 is designed to be extended from an initial length of 50 meters to a final length of 100 meters as clearance of the storage area proceeds. It is loaded with bags 9 via loading table 7, which marshals the bags onto the belt. The conveyor belt 11 is fabricated from 450 mm wide polyurethane/polyvinylchloride material to give long life and good resistance to attack by sludge petroleum from split/leaking bags. The quantity of material passed by conveyor 11 is monitored by an under-belt auto-weigh unit (not shown). This unit reads the mass of material handled in the previous minute and gives an integrated read-out showing the grand total handled, and, if required, the daily total. Bags 9 leave conveyor 11 via an off-loading table 12. A conveyor and auto weigh system of this description are obtained from F. M. Nicholson, Oldham, England.

The bags leave the off-loading table 12 and enter the bag stripping press 13 (obtainable from CPI Ltd., Mansfield, England), a 10 ton hydraulic down-stroking press, with hard rubber, shaped, dies 15, which extrude the sludge from the bags 17 in a progressive "squeezing-a-tube-of-tooth-paste" manner. Bag 17 is located in the recess of the lower die. The exposed end of bag 17 is slit, and the press is then triggered to bring down the upper platen with its shaped hard rubber top dies 15. This strips the sludge firmly from the bag 17 leaving minimum residue in the stripped bag 17. The sludge slides down steel, water lubricated, sludge chute 33 to pump hopper 41. Pump hopper 41 is jacketed and steam is fed via line 35 to the jacketing for normal heating by conduction.

The empty bags 17 slide down the empty bag chute 19 for washing in bag wash machine 25. The empty bags via chute 19 are shredded in shredder 21 (obtainable from Hidrostal Process Engineering Ltd., Newbury, England) into short strips. These strips are guided to the bag, wash machine 25 rough hopper opening 23. They are deposited in wash baskets 29 and carried through kerosene or diesel fuel wash 27 sections. The solvent chosen for cleaning the strips is one that readily solvates the sludge being treated. Usually, diesel fuel or kerosene are excellent low cost solvents for this step. The cleaning solvent is stored in tank 16 and solvent from tank 16 is fed via lines 30 and 32. Make-up cleaning solvent is added to tank 16 through line 34. Residue in tank 16 is removed via line 36.

The shreds are drained after washing and are then passed via outlet 31 to final solids disposal. The wash liquid is recirculated through line 26 by a pump (not shown), which is protected from loose bag shreds by a duplex filter with change-on-the-run capability, to lines 30 and 32. The wash solvent from line 32 is sprayed onto the strips by jets 27. When the solvent becomes excessively contaminated with sludge material, it is pumped into the sludge stream 30 and 38 to sludge hopper 41, and becomes part of the recovered product.

Sludge hopper 41 containing sludge 39, is subjected to dilution and/or heating to reduce viscosity to the extent required. One or both of sparging steam, provided through line 37 via steam line 35, and solvent, fed through line 38, can be added in ratios determined by a study of the sludge's physical properties to achieve the optimum viscosity for the remainder of sludge's treatment. These water (steam) and solvent addition points, coupled with steam jacketing, provide the maximum operational flexibility. The viscosity reduction provided by heating, sparging and solvent addition is of great assistance in insuring the appropriate viscosity for transfer from the sludge pump to the next stage. Both the solvent and steam treatment are aimed at providing an early increase in sludge temperature coupled with an associated reduction in viscosity. A spherical spiral blender (not shown) may be incorporated in hopper 41 to blend the sludge and additives. Hopper 41 is steam jacketed for heating the sludge, and steam is introduced through line 35. Steam is removed via line 42 and trap 48 from which condensate is returned to the steam generating source.

Transfer pump 43 should have the ability to transfer the driest and most viscous sludge in hopper 41. This is achieved by specifying a reciprocating type pump of generous capability, specifically designed to cope with heavy industrial sludges. A particularly desirable pump is the Abel pump (model EKP 15/RKP63) sold by Abel Pumps Ltd, Derby, England. The Abel® pump is a heavy duty reciprocating pump with special capabilities in the handling of dirt laden heavy sludges. It is fitted with easily replaceable wear liners. At this point the sludge may be without added water or solvent, or it may contain (i) up to 20% water and (ii) up to 100% (equal quantity with the sludges) of solvent.

The heated and solvated sludge is fed to a standard industrial in-line blender/heat exchanger 47, that mixes the sludge into a homogeneous mass. This is an excellent opportunity to blend in any additive. Exchanger 47 is mounted in such a way that it may be readily opened for cleaning.

The sludge forwarded by pump 43 and exchanger 47 through line 49 next passes through an in-line macerator 51 of standard industrial type (such as those obtainable from Hidrostal Process Engineering Ltd., Newbury, England) whose function is to break up any solids agglomerates in the sludge into fine particles so that the ultrasonic treatment can have maximum effect. This results in a homogeneous feed via line 53 to in-line mixer and heat exchanger 55 (obtainable from Chemineer, Derby, England) where the sludge temperature is optimized for the following ultrasonic and wash stages. The heated homogenized sludge is fed through line 57 to a first ultrasonic unit 59, where the solid matter is attacked by radiation to begin the process of dislodging the petroleum contamination from the solid particles. The frequency and wattage input of the ultrasonic unit are chosen to maximize the stripping effect while avoiding those operating areas where emulsions may form. The frequency used in this sludges treatment operation has been found by experiment to be between about 20 to about 40 kilohertz. In order to provide the most effective contact, the transducers are mounted in the faces of a hexagonal pipe. Preferred ultrasonic devices are the Tubeducer® and Cylsonic® sold by Branson Ultrasonics, Dawe Division, Hayes, Middlesex, England, in which the multiple transducers are mounted on the outer faces of a pentagonal cross-section pipe. The frequency applied is dependent upon the nature of the sludge and is determined experimentally for each major change of feed stock. The frequency typically varies within the range 20 kHz to 40 kHz, and the applied energy levels required are similarly identified to match the requirements of the particular feed stock being handled. The energy input will normally lie in the range of 120 to 200 watts per liter.

The ultrasonic unit 59 may be modified such that it becomes a pressurized vessel as a result of gas pressure build-up. With appropriate control over pressure and temperature, the solvent that is provided in the unit can be brought to its supercritical state. This enhances the solvency power and materially facilitates the dissolution of petroleum from the solids.

After the ultrasonic treatment, the treated sludge is passed by way of line 60 to which is injected further solvent through line 94 into the sludge stream to reduce the viscosity and to assist in dissolving of the separated petroleum from the solid particles. Shown in FIG. 1 are two blending stages. One blending stage may be sufficient. Two blending stages cover all eventualities.

The solvent is selected to suit the characteristics of the particular waste petroleum being treated. The solvent used may be selected from a wide range of aliphatic and aromatic solvents, examples include kerosene, diesel fuel and toluene. Toluene is the proposed solvent in this case. Make-up of the solvent will be achieved by adding toluene, by way of line 118 to tank 96, to the light ends from the recovered petroleum. The percentage solvent added will generally lie in the range 0 to 150%, basis weight of the sludge. The final ratio of solvent to sludge, in this case the Singapore sludges, is expected to be variable within the range 75% to 150%, under the control of the variable speed solvent feed pump 58. Undesirable feed back of solvent is prevented by a non-return valve (not shown) in line 60. The intimate blending of solvent and sludges that is desirable for even separation of petroleum from solids is obtained by passing the mixture through in-line mixer 61 (obtainable from Chemineer, Derby, England) where the sludge and solvent are blended. A dosing point (not shown) is provided in lines 63 or 60 to permit the introduction of emulsion breaking chemicals, as necessary.

The sludge/solvent mixture is now fed through line 62 into the first wash stage, to the first wash stage vessel 63. The sludge and solvent enter in an upward direction in order to give optimum flotation characteristics. The water contained in the unit is sea water introduced through line 44 in order to give maximum specific gravity differential between the petroleum in the sludges and the water. Fresh water may be employed instead or any extraction non-solvent for the petroleum and the solvent that has the appropriate specific gravity for the separation. The petroleum, released by the attack of the ultrasonic treatment and by the action of the solvent, floats up with the solvent through the water layer to the top surface 56 at the upper part of vessel 63 through distribution plate 24 forcing a separation of the solids, petroleum and solvent. The heavier solids 69 separate out and fall to the conical bottom of vessel 63.

Vessel 63 has steam jacket 65 with 3.5 bar steam inputted through line 64, and steam condensate line 20 that removes the condensed steam from the jacket and to maintain water temperature for good separation. Water make-up in vessel 63, to cover losses due to the extraction of solids, is controlled by an automatic level control system (not shown) resting at the interface between the petroleum/solvent and water layers. It switches on a hot-water make-up centrifugal pump (not shown) in water entry line 44 to restore the water level.

Deposited solids 69 are withdrawn from the conical base of the vessel 63 by a solids handling pump (not shown) (obtainable from Tuthill UK Ltd., Ilkeston, England) in line 70. To facilitate solids 69 removal at this point, internal jet sluicing (not shown) with hot water is provided in the conical bottom of vessel 63. Extracted petroleum-rich mixture with solvent is removed from the top of the vessel by a level controlled pump (not shown) in line 67 controlled by a level located in vessel 63 above the distribution plate 24. This unit feeds the mixture to evaporator 84 where petroleum and solvent are separated. Solvent vapor containing some petroleum is drawn off from the top region 56 of wash vessel 63, and goes directly by way of line 66 to condenser 93 for recovery. Line 66 from vessel 63 joins with line 79 from second wash vessel 75 to transport solvent vapor from the first and second wash vessels to condenser 93.

The once washed sludges' solids are pumped via line 70 to in-line mixer 100 where the sludges and residual solvent are blended. Unwanted feed-back is prevented by a non-return valve. This is followed by (a) solvent addition via line 92, controlled by variable speed solvent feed pump 40, and (b) addition to ultrasonic unit 71 comparable to ultrasonic unit 59 is size and mode of operation. Solvent line 92 is directly connected (not shown) to line 94 before pump 58. The diluted solids are then passed by way of feed line 73 into second wash vessel 75 that is the same as vessel 63. Items of vessel 75 that are comparable to items of vessel 63 are depicted in the following table:

| Item of vessel 63 | Item of vessel 75 | Item of vessel 63 | Item of vessel 75 |
|---|---|---|---|
| 24 | 28 | 64 | 77 |
| 20 | 22 | 67 | 80 |
| 44 | 46 | 68 | 76 |
| 56 | 72 | 69 | 74 |
| 62 | 73 | | |

The operation of second wash vessel 75 is the same described for first wash vessel 63 and when the streams are removed, be they solvent, petroleum or solid, the operation is the same. Jet sluicing as provided before is used at the conical bottom of the second wash vessel to remove solids 74. Line 81 from the second wash vessel to the solids pump (not shown) feeds the solids to vessel 83. This vessel provides solvent flash-off from the second wash stage solids. The solvent flashed off goes directly to condenser via lines 85 and 66, respectively. The final residue in vessel 83 is passed by line 52 to Torbed processing unit 50 where final removal of petroleum by volatilization from the residue solid takes place bringing the petroleum content of the discharged solids to less than about 0.1 weight percent. The vapors produced can be condensed and removed from the Torbed exhaust gas stream, if desired, for environmental reasons. The condensed matter can be reintroduced to the product stream. Choice of condenser and coolant temperature enables selective condensation to be carried out, aimed at the elimination of particular substances, if required. The clean solid wastes have sufficiently low petroleum contents to be sent to landfill 54.

Separated petroleum with solvent from the two wash stages are fed via line 18 (collected from lines 67 and 80) to the reboiler stage of the evaporator column 84 (obtainable from Alval Engineering, Fife, Scotland). Solvent is flashed-off by the steam heating coils and the vapors pass up column 84 to line 82 and collected in line 66 with the solvent vapor from the two wash stages, all of which with the aid of pump 86 are fed to condenser 93. This unit comprises coil(s) 95, venting 98, and fan 97 for air cooling. The condensed materials are withdrawn by pump 116, and go to storage tank 96 via line 99.

The petroleum from evaporator column 84 is fed by way of line 88 to tank 89 that provides buffer holding capacity en route to the hydrocyclone stage. The petroleum in tank 89 is withdrawn through line 90 with the aid of pump 102, to line 103. A heat exchanger 105 (obtainable from Transon Heat Engineering Ltd., Andover, England) that is controlled to a set value by a control valve (not shown) in the steam line, is incorporated in line 90 to optimize temperature of the hydrocyclone. From heat exchanger 105, the petroleum condensate is fed by line 106 to hydrocyclones 109 and 110 (obtainable from Conoco Specialty Products Limited, Gloucester, England) connected by line 112, after picking up any needed hot water (optionally supplied) fed to line 106 through line 107 to aid in the hydrocyclone separation. Hydrocyclone 109/110 comprise a skid that contains three or four hydrocyclone units (two only are shown, 109 and 110, interconnected by line 112), depending on the water and petroleum quantities and qualities in the recovered petroleum stream. Water is removed via line 113. All effluent waters from plant are passed to a standard type inclined plate separator to remove traces of petroleum so that final effluent water oil contents are an order below current legal requirements, desirably less than about 50 ppm petroleum in the water, preferable less than about 10 ppm petroleum. Petroleum creamed off at this stage is returned to the product stream. If necessary, pH adjustment is made to eliminate alkalinity and acidity, and flocculation aids are added to remove unacceptable solids in the discharged water or the effluent water may be passed through a membrane type filter in order to remove the final traces of solvent.

The hydrocyclone is an integrated unit comprising a first petroleum separation stage, followed by a second water clean-up stage, capable of providing effluent water with a petroleum content of less than about 50 ppm. To give optimum cleaning in the hydrocyclone, additional water can be added through line 107 if required. Petroleum and water recycle is effected by passing petroleum contaminated with water to holdup tank 89 via line 91 to be mixed with the petroleum feed to the hydrocyclones.

Petroleum from the hydrocyclones is fed by way of line 111 to balance tank 101 situated between the hydrocyclones and the centrifuge stage. Tank 101 is heated to permit adjusting of the petroleum temperature for optimum centrifuging. Petroleum from tank 101 is fed through line 104 to temperature trimming heat exchanger 108, and then through line 114 to the centrifuge unit 115 (obtainable from Westfalia, Milton Keynes, England). Finally "polished" petroleum is taken, aided by pumps (not shown), from centrifuge unit 115, is fed to storage tanks 123 and 129 (steam-coil heated and fitted with level controls and indicators) via a petroleum in water meter (not shown) (obtainable from Agar/Auriema Ltd, Slough, England), which checks product quality. The centrifuge 115 is a complete operating unit as supplied by the manufacturer, and contains a temperature trimming heat exchanger, feed tank, high speed centrifuge, and sludges extraction pump. Sludges removed from the centrifuge is fed to holding tank 121. As fed from the hydrocyclone output, this unit is capable of providing B, S & W values well within a nominally specified 2% maximum. The sludges in tank 121 may be fed to Torbed 50 for final treatment.

To insure that the extracted solids are satisfactorily dean for use as landfill, they are passed through a "Torbed" cleansing unit 50 (obtainable from Davy McKee, Stocton-on-Tees, England). The "Torbed" unit passes hot gases from a petroleum burner as a spiralled gas stream directed to angularly positioned blades into a bed of petroleum contaminated particles, specifically siliceous and the other type particles, to form a turbulent gas-supported bed of the contaminated solids, removing any remaining petroleum by vaporization, and giving a clean dry particulate product. Petroleum in the exhaust gas stream is recovered by condensation. Since the heating process is closely controlled, the undesirable elements produced by incineration are avoided, and emissions are more easily held within specified local authority limits.

Figure 3:
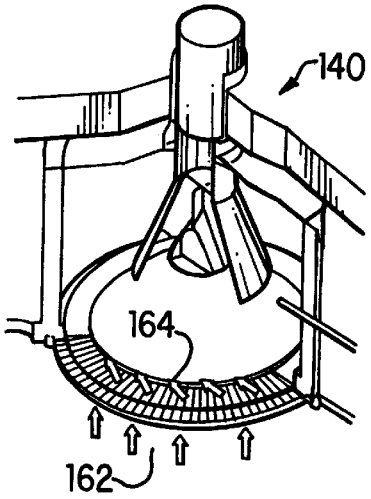
FIG. 3 is the same view as FIG. 2 except that it illustrates gas flow through the fix blades used in the apparatus.
Figure 4:
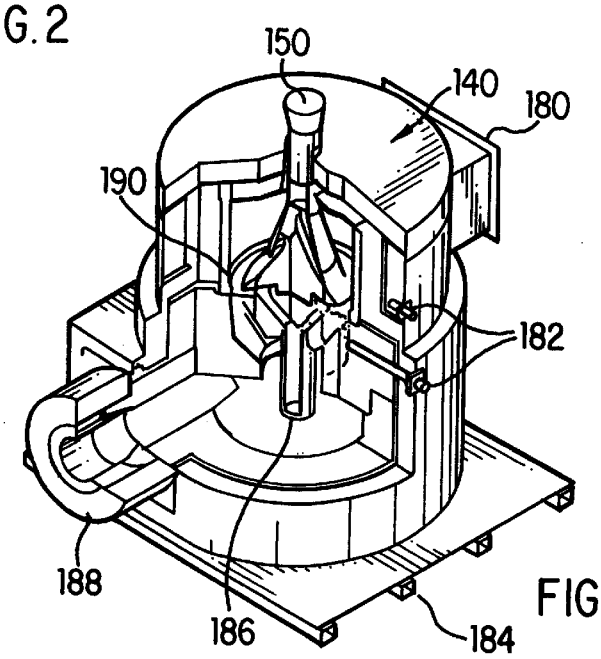
FIG. 4 is the same view as FIGS. 2 and 3 showing additional features of the apparatus, such as the burner.
Figure 5:
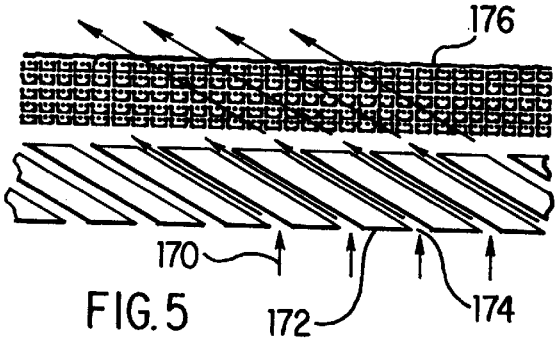
FIG. 5 is a cross section schematic side view of the dynamic bed formed in operation of the apparatus of FIGS. 2 and 3 and the fix blades used in directing fluid flow.

The Torbed Process is illustrated in FIGS. 2, 3, 4 and 5. As shown in the figures, the Torbed device 140 contains within a cylindrical insulated wall 160 a feed tube 150 through which the particulate solids are fed to be discharged from the other end 152 into rotating vanes onto a sloping surface 154 to be ejected to the peripheral blade zone 190 enclosed by an inwardly sloped overhang surface 158. Hot fluid from burner 188 is injected tangentially creating an upward flow 156 through the particles sufficient to form a dynamic particle bed. As shown in FIG. 3, hot fluids 162 are emitted through blades 164 that ejects the fluid in an angular direction 164. The hot fluid leaves the device through fluid exhaust outlet 180 carrying with it the vaporized petroleum that coated the particles. The hot fluid is fed to a condenser that allows the petroleum component to separate. The treated fluid is subjected to scrubbing to ensure petroleum removal. A dynamic bed of hot particles 176 is spiraled about zone 158 in direction 164 that follows the pitch of blades 172 and the tangential feed from burner 188. As shown in FIG. 5, the hot fluid 170 is fed to the blade zone between the blades 172 in the spaces 174 between blades 172 and the slant of blades 172 causes the fluid stream to have a similarly angular pitch as shown by the arrows above the array of blades 172. The particles fed to the device form dynamic bed 176 that travels in the direction of the fluid stream restrained by the geometry of the path of the peripheral blade zone 158. This is fully discussed in U.S. Pat. No. 4,479,920, supra. The fluid may be at a temperature higher than 1400° C., preferably at a temperature of from about 100° C. to about 1400° C., most preferably from about 150° C. to a temperature less than about 1400° C., measured by thermocouples 182, as the hot fluid flows around the particles, suspending them and vaporizing petroleum adhering to the particles. The fluid is generally combustion gases that emanate from the burner. However, the burner assembly that issues the hot gases in a spiral direction into the array of blades 172, may be fitted with injection sites downstream of the burner so that other gaseous or vaporous materials may be incorporated in the fluid stream. Such materials include a variety of gases such as air, carbon dioxide, nitrogen, methane, ethane, propane, isopropane, hexane, and the like. It is desirable to use as the fluid, a gaseous mixture that is capable of dissolving the petroleum affixed to the particles. This materially facilitates the removal of the petroleum from the particles by a combination of vaporization and extraction. The solids are recovered in the central discharge chamber 186 and sent to landfill.

What is claimed is:

1. A process for reclaiming petroleum from waste petroleum which comprises the steps of isolating a water petroleum composition that has a solids content of from about 1 weight percent to about 98 weight percent, a petroleum content of from about 1 weight percent to about 98 weight percent, and a water content of from about 1 weight percent to about 98 weight percent, in which the petroleum is mixed with solids and water contaminants, decoupling association of the petroleum with the contaminants by solvent treatment and subjecting the solvent containing mixture with petroleum to an ultrasonic treatment at a rate in cycles per second sufficient to note an increase in the separation of the solids component from the petroleum component without substantial emulsification with the water that is present, wherein the combination of solvent and ultrasonic treatments activates the solvation of the petroleum such that more is extracted from solids on a per volume basis than with the solvent treatment alone, thereby to form a mixture comprising a solvent solution containing petroleum, and solids and water contaminants, separating the contaminants by washing with a non-solvent for the petroleum component and the solvent, and then separating the petroleum from the solvent.

2. The process of claim 1 wherein the solvent is water-immiscible and the ultrasonic treatment is sufficient to enhance separation of the petroleum from the solids without emulsification of water and petroleum.

3. The process of claim 2 wherein the non-solvent is water.

4. The process of claim 3 wherein the water is sea water.

5. The process of claim 2 wherein the solvent is separated from the petroleum by distillation.

6. The process of claim 4 wherein the solvent is separated from the petroleum by distillation.

7. The process of claim 5 wherein the separated petroleum is subjected to hydroseparation.

8. The process of claim 6 wherein the separated petroleum is subjected to hydroseparation.

9. The process of claim 3 wherein there is a petroleum-rich component from the separation and it is subjected to hydroseparation.

10. The process of claim 4 wherein there is a petroleum-rich component from the separation and it is subjected to hydroseparation.

11. The process of claim 7 wherein the hydroseparation is followed by one or more of decantation and centrifugation to separate out residual solids.

12. The process of claim 8 wherein the hydroseparation is followed by one or more of decantation and centrifugation to separate out residual solids.

13. The process of claim 9 wherein the hydroseparation is followed by one or more of decantation and centrifugation to separate out residual solids.

14. The process of claim 10 wherein the hydroseparation is followed by one or more of decantation and centrifugation to separate out residual solids.

15. The process of claim 3 wherein the separated solids are fed as solid particles to a toroidal dynamic bed suspended in a hot fluid whereby to separate petroleum deposits from the particles.

16. The process of claim 4 wherein the separated solids are fed as solid particles to a toroidal dynamic bed suspended in a hot fluid whereby to separate petroleum deposits from the particles.

17. The process of claim 5 wherein the separated solids are fed as solid particles to a toroidal dynamic bed suspended in a hot fluid whereby to separate petroleum deposits from the particles.

18. The process of claim 6 wherein the separated solids are fed as solid particles to a toroidal dynamic bed suspended in a hot fluid whereby to separate petroleum deposits from the particles.

19. The process of claim 15 wherein the solids are deposited in a landfill.

20. The process of claim 16 wherein the solids are deposited in a landfill.

21. The process of claim 17 wherein the solids are deposited in a landfill.

22. The process of claim 18 wherein the solids are deposited in a landfill.

23. A process for reclaiming petroleum from waste petroleum which comprises the steps of isolating a water petroleum composition that has a solids content of about 1 weight percent to about 98, a petroleum content of from about 1 weight percent to about 98 weight percent, and a water content of from about 1 weight percent to about 98 weight percent, in which the petroleum is mixed with solids and water contaminants, controlling the composition of the waste petroleum to homogenize enough of the waste petroleum composition to exceed the throughput of cycle of the process so that in any cycle of the process, there is an average composition being treated, decoupling association of the petroleum with the contaminants by solvent treatment and subjecting the solvent containing mixture with petroleum to an ultrasonic treatment at a rate in cycles per second sufficient to note an increase in the separation of the solids component from the petroleum component without substantial emulsification with the water that is present, wherein the combination of the solvent and ultrasonic treatments activates the solvation of the petroleum such that more is extracted from solids on a per volume basis than with the solvent treatment alone, thereby to form a mixture comprising a solvent solution containing petroleum, and solids and water contaminants, separating the contaminants by washing with a non-solvent for the petroleum component and the solvent, and then separating the petroleum form the solvent.

* * * * *